US005931028A

United States Patent [19]

Shin et al.

[11] Patent Number: 5,931,028

[45] Date of Patent: Aug. 3, 1999

[54] FILTER FOR A WASHING MACHINE

[75] Inventors: Jung-soo Shin; Chang-young Lee, both of Suwon, Rep. of Korea

[73] Assignee: Samsung Electronics Co., Ltd., Suwon, Rep. of Korea

[21] Appl. No.: 09/028,527

[22] Filed: Feb. 24, 1998

[30] Foreign Application Priority Data

Jul. 21, 1997 [KR] Rep. of Korea ..... 97-34101
Aug. 16, 1997 [KR] Rep. of Korea ..... 97-39036

[51] Int. Cl.[6] ..... D06F 39/10

[52] U.S. Cl. ..... 68/18 F; 210/136; 210/167; 210/232; 210/485; 210/497.01

[58] Field of Search ..... 68/18 F; 210/136, 210/167, 232, 485, 497.01

[56] References Cited

U.S. PATENT DOCUMENTS 5,509,283 4/1996 Lee et al. ..... 68/18 F

FOREIGN PATENT DOCUMENTS 230394 9/1989 Japan ..... 68/18 F
285595 10/1992 Japan ..... 68/18 F
288 469 10/1996 Taiwan .

*Primary Examiner*—Philip R. Coe
*Attorney, Agent, or Firm*—Burns, Doane, Swecker & Mathis, L.L.P.

[57] ABSTRACT

Disclosed a filter for a washing machine including a filter case attached to an inner lower portion of a dehydrating tub of the washing machine for forming a predetermined space with the dehydrating tub; and a pocket type filter including a front panel attached with a mesh net to one side thereof for filtrating fluff intermingled in the washing water, a rear panel for forming a predetermined space with the front panel by being coupled to the front panel by means of a hinge shaft to be opened/closed while being attached with a mesh net for filtering the fluff intermingled in the washing water to one side thereof, and a check valve fixed to the lower side of the rear panel for confining the flow of the washing water introduced into the space between the front panel and the rear panel. The filter is attached to the inner lower side of the washing machine. Consequently, when the small amount of articles is washed, the washing water reaches up to the filter, making it possible to thoroughly filtrate the fluff intermingled in the washing water.

3 Claims, 5 Drawing Sheets

FILTER FOR A WASHING MACHINE

RELATED INVENTION

This invention is related to inventions disclosed in commonly assigned U.S. Pat. Nos. 5,858,220 issued Jan. 12, 1999; 5,863,423 issued Jan. 26, 1999, 5,849,182 issued Dec. 15, 1998, U.S. Application Ser. Nos. 09/028,526, 09/028,354, and 09/028,668 filed on Feb. 24, 1998, respectively.

BACKGROUND OF THE INVENTION

1. Field of the Invention

The present invention relates to a washing machine, and more particularly to a filter for a washing machine for filtering foreign matters such as fluff from washing water.

2. Description of the Prior Art

FIG. 1 illustrates a conventional washing machine. Referring to FIG. 1, in the conventional washing machine, a washing tub 120 is suspended by a suspension 130 into inside of a case 110.

A dehydrating tub 170 and a pulsator (or an agitator; hereinafter a pulsator) 180 selectively driven by a clutch assembly 160 which is connected to a motor 150 by means of a belt 140, are disposed in the inner side of washing tub 120.

An impeller 182 as a pump is integrally formed to the lower side of pulsator 180, and a filter 190 is provided around the upper end of dehydrating tub 170. A guide portion 172 for guiding the washing water pumped by impeller 182 toward filter 190 is formed between impeller 182 and filter 190.

In the washing machine constructed as above, once pulsator 180 is rotated by motor 150 and clutch assembly 160 during a washing or rinsing cycle, the washing water pumped by impeller 182 at the lower portion of pulsator 180 is guided to filter 190 along guide portion 172 to be dropped into the interior of dehydrating tub 170 via filter 190. During this process, foreign matters intermingled in the washing water are filtered by filter 190.

However, according to the conventional washing machine constructed as above, filter 190 is arranged around the upper end of dehydrating tub 170. For this reason, when a small amount of articles is washed in a small quantity of cleaning water, the washing water cannot reach filter 190. That is, the foreign matters intermingled in the washing water cannot be sufficiently filtered by filter 190 to lower washing efficiency.

SUMMARY OF THE INVENTION

Therefore, it is an object of the present invention to provide a filter for a washing machine capable of thoroughly filtering foreign matters intermingled in washing water when a small amount of articles is to be washed by a small quantity of washing water.

To achieve the object, the present invention provides a filter for a washing machine comprising a filter case attached to an inner lower portion of a dehydrating tub of the washing machine for forming a predetermined space with the dehydrating tub; and a pocket type filter including a front panel attached with a mesh net to one side thereof for filtrating fluff intermingled in the washing water, a rear panel for forming a predetermined space with the front panel by being coupled to the front panel by means of a hinge shaft to be opened/closed while being attached with a mesh net for filtering the fluff intermingled in the washing water to one side thereof, and a check valve fixed to the lower side of the rear panel for confining the flow of the washing water introduced into the space between the front panel and the rear panel.

In a embodiment of the present invention, the filter case includes an attachment portion for being attached to the dehydrating tub, inserting guides having upper portions opened, the pocket type filter being slidably inserted into the interior thereof from the opened upper portion, and a plurality of discharging holes for discharging the washing water having passed through the mesh nets of the pocket type filter into the interior of the dehydrating tub.

In other embodiment of the present invention, the filter case includes also an attachment portion for being attached to the dehydrating tub, and a filter receiving portion formed with an opening portion to be inserted with the pocket type filter from the preceding side thereof.

The filter according to the present invention is attached to the inner lower side of the washing machine. Consequently, when the small amount of articles is washed, the washing water reaches up to the filter, making it possible to thoroughly filtrate the fluff intermingled in the washing water.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
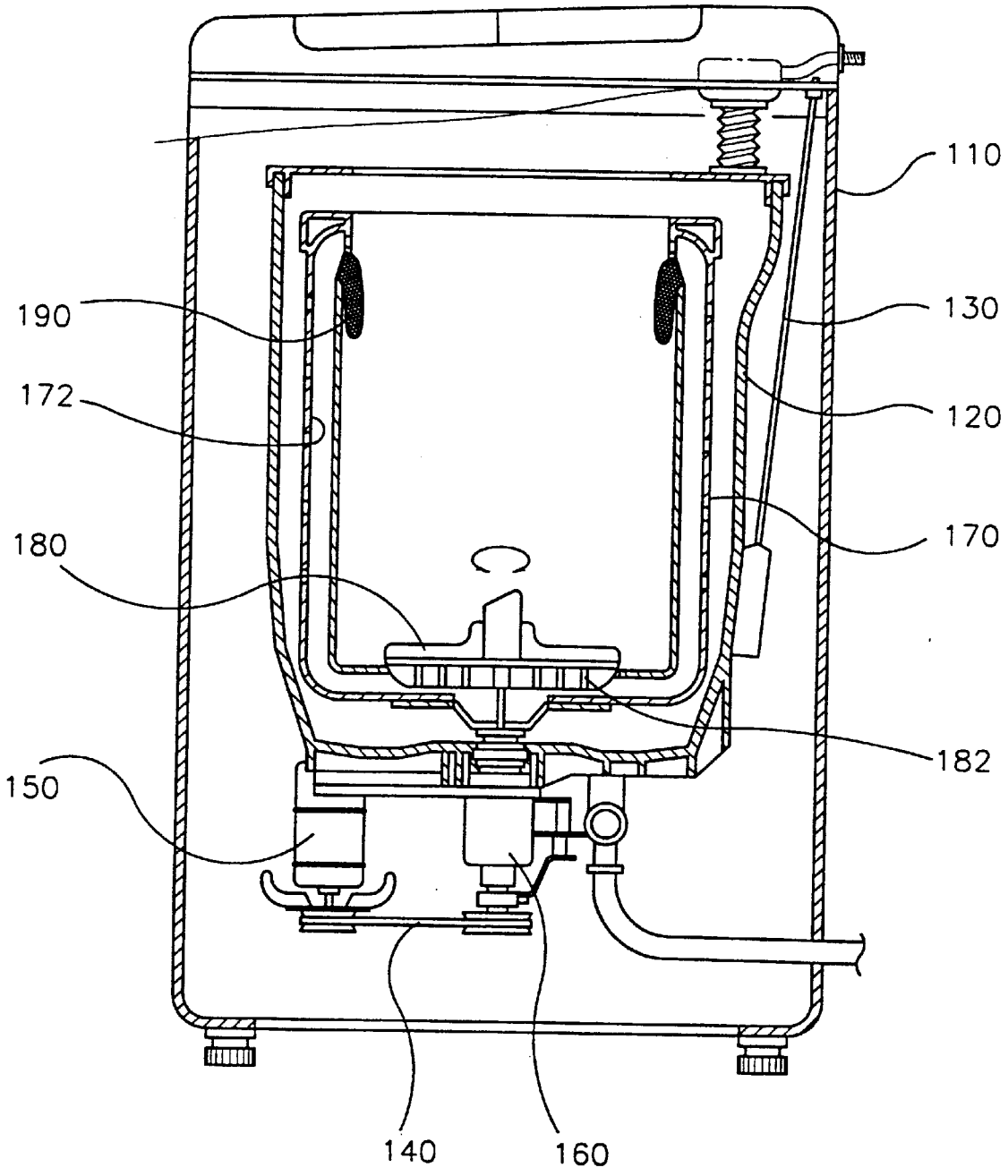
FIG. 1 (PRIOR ART)
FIG. 1 is a sectional view showing a general full automatic washing machine.
Figure 2:
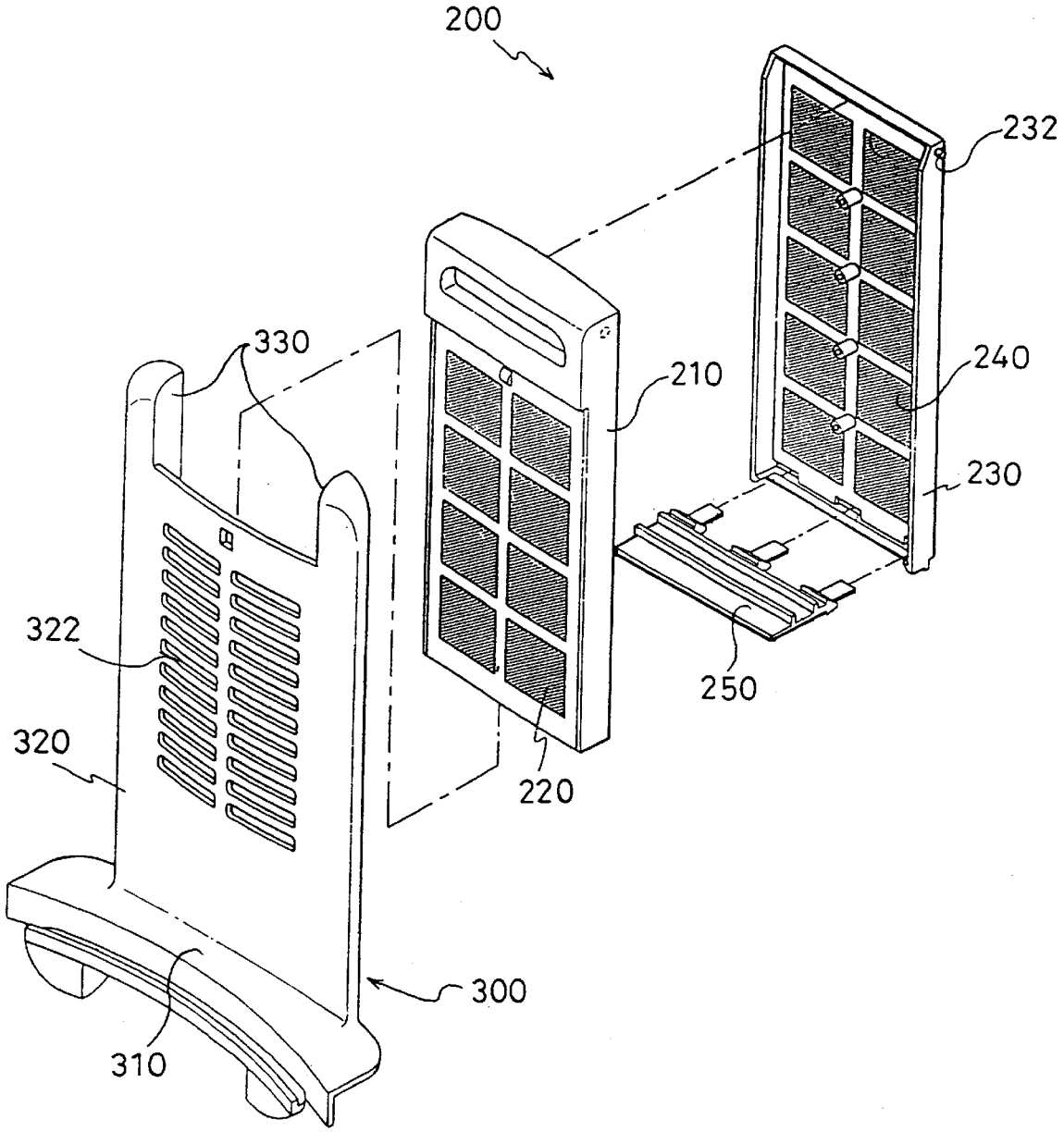
FIG. 2 is an exploded perspective view showing a filter for a washing machine according to a first embodiment of the present invention.
Figure 3:
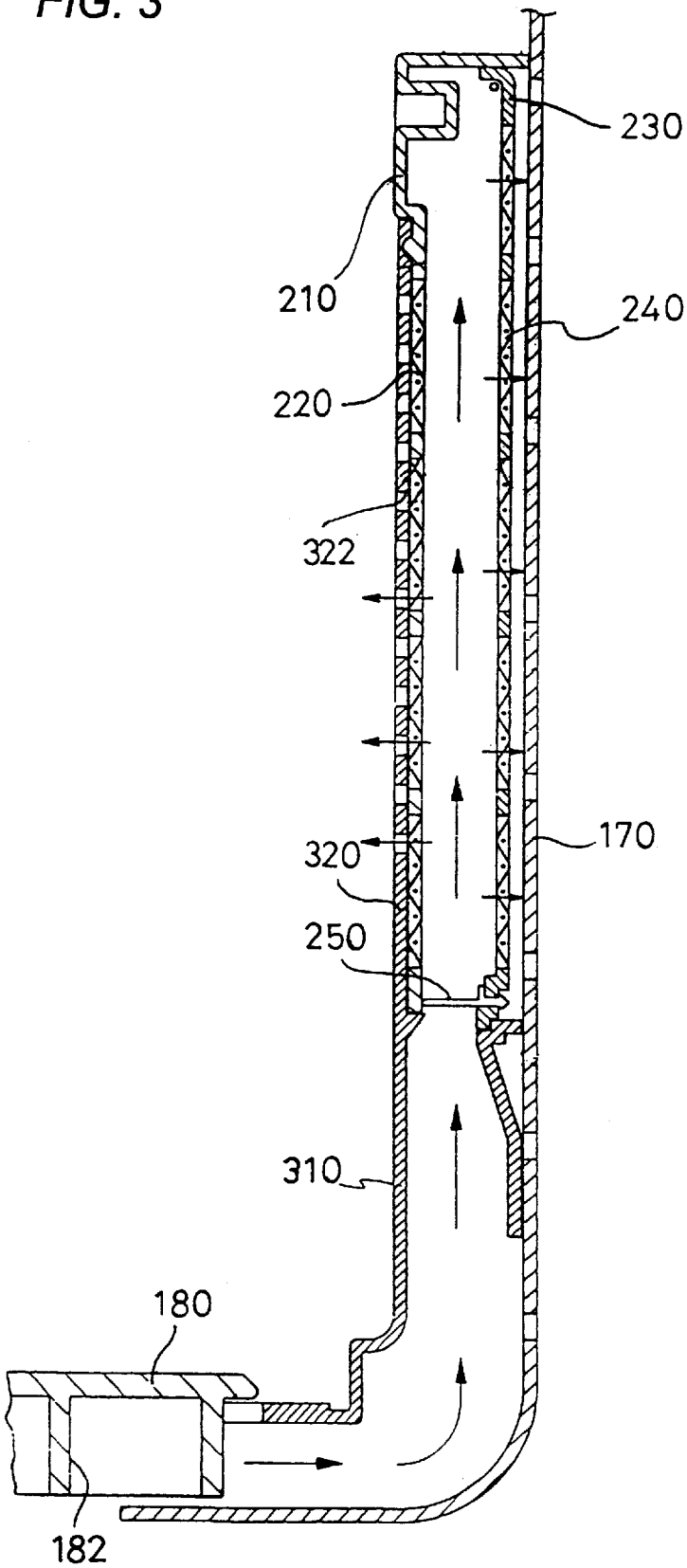
FIG. 3 is a sectional view showing the filter for the washing machine according to the first embodiment of the present invention attached to the inner lower portion of the dehydrating tub.

A filter according to a first embodiment of the present invention is shown in FIGS. 2 and 3. As illustrated, a filter for a washing machine according to the present invention is attached to the inner lower portion of a dehydrating tub 170, which includes a filter case 300 and a pocket type filter 200 for filtering fluff by being inserted into a filter case 300.

Filter case 300 is attached to the inner lower portion of a dehydrating tub 170 to form a predetermined space with dehydrating tub 170, which includes an attachment portion 310 for attaching itself onto dehydrating tub 170, a front plane portion 320 formed with a plurality of discharging holes 322 and inserting guide portions 330 formed to both rear sides of front plane portion 320 while having the upper portion opened.

Pocket type filter 200 includes a front panel 210, a rear panel 230 and a check valve 250. Front panel 210 and rear panel 230 are coupled to be opened/closed by a hinge shaft 232 formed to rear panel 230, and attached with mesh nets 220 and 240 for filtering the fluff. Check valve 250 for opening/closing the space between front panel 210 and rear panel 230, is fixed to the lower side of rear panel 230 and made of a material such as a rubber.

Pocket type filter 200 as described above is inserted into the interior of the space between filter case 300 and dehydrating tub 170 by being slidably moved along inserting guide portions 330 from the upper portion of inserting guide portions 330 of filter case 300.

According to the first embodiment of the present invention as described above, the washing water pumped by impeller 182 flows into pocket type filter 200 via the space between dehydrating tub 170 and filter case 300 during the washing or rinsing cycle. Check valve 250 is upwardly pushed away by means of the washing water thereby the washing water is introduced into the interior of pocket type filter 200.

The washing water introduced into inside of pocket type filter 200 is discharged into dehydrating tub 170 via mesh nets 220 and 240 of front panel 210 and rear panel 230. At this time, the fluff within the washing water is filtered by mesh nets 220 and 240 attached to the front panel 210 and rear panel 230. Also, the washing water exhausted out of pocket type filter 200 is discharged into the interior of dehydrating tub 170 via discharging holes 322 formed in front plane portion 320 of filter case 300.

Under the state that the rotation of a pulsator is stopped after completing the washing or rinsing cycle, check valve 250 returns to its original position by means of gravity. Consequently, the filtered fluff is accumulated into the interior of pocket type filter 200 without getting away from pocket type filter 200.

The fluff accumulated on the interior of pocket type filter 200 is closely attached toward rear panel 230 due to a centrifugal force exerting upon the fluff by dehydrating tub 170 which is rotated at high speed during a dehydrating cycle. By doing so, the washing water pumped by impeller 182 can be easily introduced into pocket type filter 200 during the initial period of the next washing or rinsing cycle.

Meantime, when the fluff becomes greatly gathered within the interior of pocket type filter 200, pocket type filter 200 is separated from filter case 300. Then, pocket type filter 200 is opened to remove the accumulated fluff.

The filter according to the aforementioned first embodiment of the present invention is attached to the inner lower side of the dehydrating tub. Therefore, when the small amount of articles is washed by the small quantity of washing water, the washing water pumped by the impeller can be sufficiently introduced into the interior of the pocket type filter attached to the lower side of the dehydrating tub. As the result, the fluff intermingled in the washing water can be thoroughly filtered to increase the washing efficiency.

Figure 4:
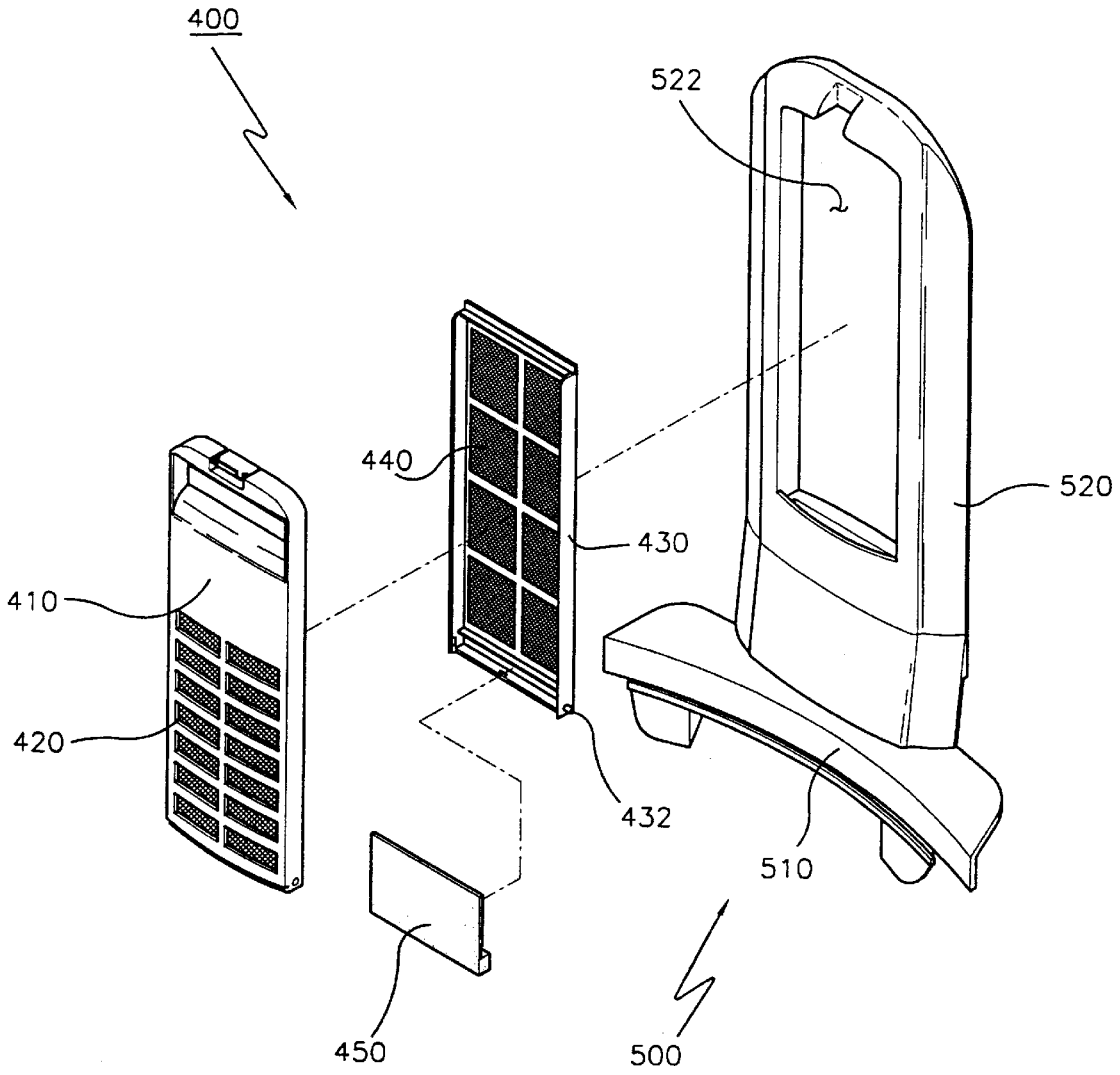
FIG. 4 is an exploded perspective view showing the filter for the washing machine according to a second embodiment of the present invention.
Figure 5:
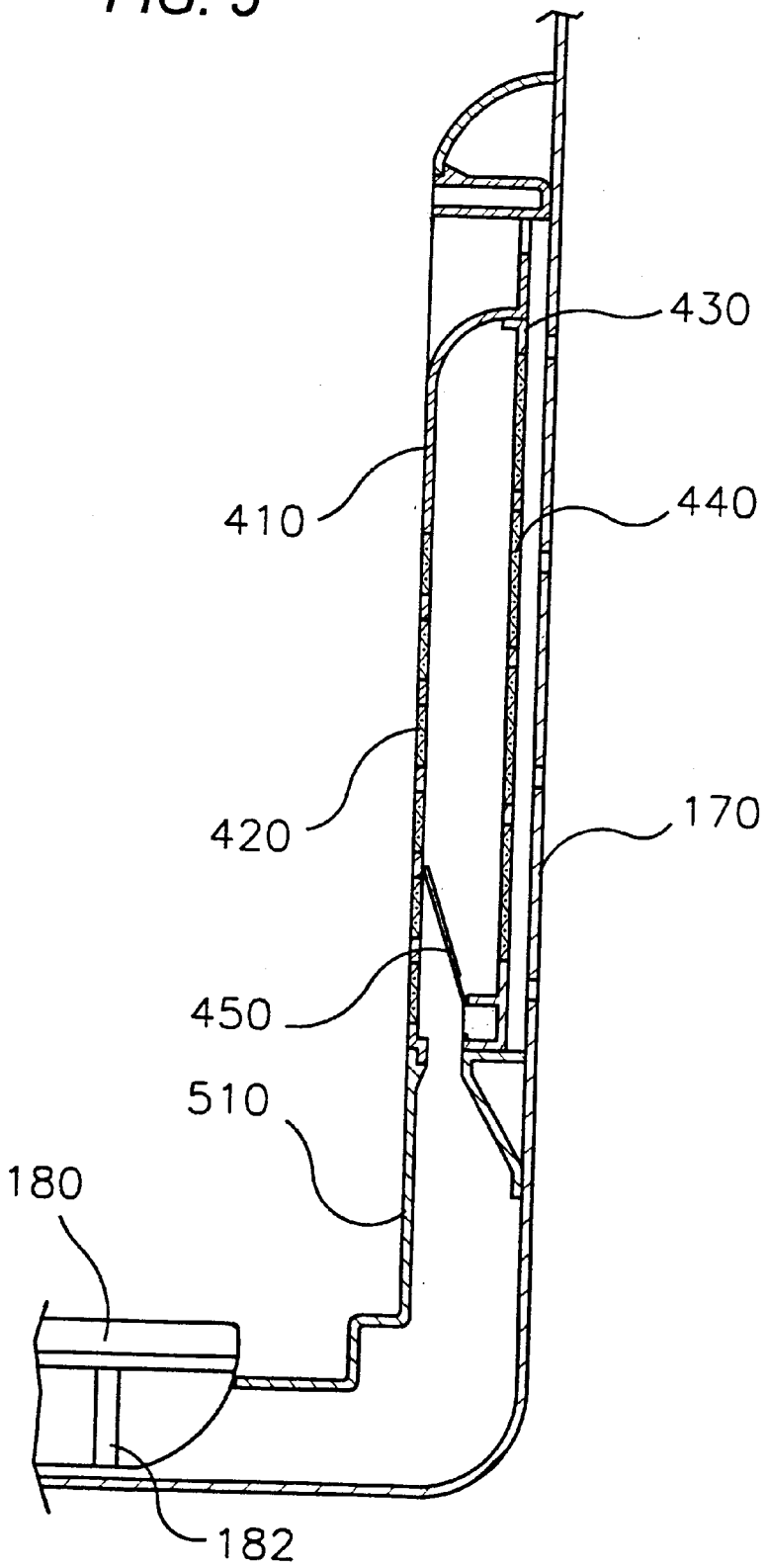
FIG. 5 is a sectional view showing the filter for the washing machine according to the second embodiment of the present invention attached to the inner lower portion of the dehydrating tub.

FIGS. 4 and 5 show a filter for the washing machine according to a second embodiment of the present invention.

As illustrated, the filter for the washing machine according to the second embodiment of the present invention includes a filter case 500 attached to the inner lower side of dehydrating tub 170 to form a predetermined space with dehydrating tub 170, and a pocket type filter 400 inserted into filter case 500 for filtering fluff.

Filter case 500 has an attachment portion 510 for attaching itself onto dehydrating tub 170, and a filter receiving portion 520 formed with an opening portion 522 for being inserted with pocket type filter 400 from the preceding side thereof.

Pocket type filter 400 includes a front panel 410, a rear panel 430 and a check valve 450. Front panel 410 and rear panel 430 are coupled to be opened/closed by a hinge shaft 432 formed to rear panel 430, and attached with mesh nets 420 and 440 for filtering the fluff. Check valve 450 formed of a substance such as a rubber is fixed to the lower side of rear panel 430 for opening/closing the space between front panel 410 and rear panel 430.

Pocket type filter 400 is accommodated within filter receiving portion 520 by being inserted into opening portion 522 of filter receiving portion 520 from the preceding side of filter case 500.

The filter for the washing machine according to the second embodiment of the present invention having the above-described construction filters the fluff intermingled in the washing water through the operation identical to that of the first embodiment.

That is, check valve 450 is upwardly pushed away by means of the washing water thereby the washing water is introduced into the interior of pocket type filter 400. After this, the washing water is discharged into the interior of dehydrating tub 170 via mesh nets 420 and 440 of front panel 410 and rear panel 430. At this time, the fluff intermingled in the washing water is filtered by mesh nets 420 and 440 attached to the front panel 410 and rear panel 430.

While the washing water passing through mesh nets 220 and 240 is discharged into the interior of dehydrating tub 170 via discharging holes 322 formed in front plane portion 320 of filter case 300 in the first embodiment, the washing water passing through mesh nets 420 and 440 is directly discharged into the interior of dehydrating tub 170 in the second embodiment.

Additionally, when the washing or rinsing cycle is completed, check valve 450 returns to its original position. Consequently, the filtered fluff is accumulated onto the interior of pocket type filter 400 without getting away from pocket type filter 400. The fluff accumulated on the interior of pocket type filter 400 is removed from of pocket type filter 400 by opening pocket type filter 400 after detaching it from filter case 500.

The filter according to the foregoing second embodiment of the present invention is also attached to the inner lower side of the dehydrating tub. Therefore, when the small amount of articles is washed by the small quantity of washing water, the washing water pumped by the impeller can be sufficiently introduced into the interior of the pocket type filter attached to the lower side of the dehydrating tub. As the result, the fluff intermingled in the washing water can be thoroughly filtrated to increase the washing efficiency.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A washing machine comprising a dehydrating tub for containing wash water, and a filter mounted on a cylindrical wall of the tub for filtering wash water, the filter comprising:

a filter case connected to a wall of the tub, and defining a filter-receiver portion; and a filter mounted in the filter-receiver portion and including:

a front panel facing an interior of the tub and carrying a filtering mesh, a rear panel hinged to the front panel and carrying a filtering mesh, a space formed between the front and rear panels and including a water inlet at a lower end thereof for admitting a flow of wash water to be passed through the filtering meshes of the front and a rear panels, and a check valve adjacent the water inlet of the space for preventing a backflow of wash water out of the space.

2. The washing machine as claimed in claim 1, wherein the filter case comprises:

an attachment portion attached to the dehydrating tub; inserting guides forming an upwardly facing opening, the filter being slidably inserted downwardly into the filter receiver portion through the opening; and a plurality of discharging holes for discharging the washing water having passed through the meshes of the filter into the interior of the dehydrating tub.

3. A washing machine as claimed in claim 1, wherein the filter case comprises an attachment portion attached to the cylindrical wall of the dehydrating tub, the filter-receiver portion having an opening facing away from the cylindrical wall for receiving the filter.

* * * * *